US006767248B1

(12) United States Patent
Hung

(10) Patent No.: US 6,767,248 B1
(45) Date of Patent: Jul. 27, 2004

(54) CONNECTOR FOR COAXIAL CABLE

(76) Inventor: Chen-Hung Hung, No. 26, Lane 88, Fu-Shing Rd., Chung-Le Tsun, Ming-Shiung Hsiang, Chia-Yi Hsien (TW)

( * ) Notice: Subject to any disclaimer, the term of this patent is extended or adjusted under 35 U.S.C. 154(b) by 0 days.

(21) Appl. No.: 10/705,985

(22) Filed: Nov. 13, 2003

(51) Int. Cl.[7] ..... H01R 9/05
(52) U.S. Cl. ..... 439/578; 439/584
(58) Field of Search ..... 439/578, 583, 439/584, 585

(56) References Cited

U.S. PATENT DOCUMENTS 3,907,399 A * 9/1975 Spinner ..... 439/583
6,217,383 B1 * 4/2001 Holland et al. ..... 439/578
6,530,807 B2 * 3/2003 Rodrigues et al. ..... 439/578

* cited by examiner

*Primary Examiner*—Son V. Nguyen
(74) *Attorney, Agent, or Firm*—Troxell Law Office PLLC

(57) ABSTRACT

Connector connectable to a coaxial cable is disclosed. The connector includes outer and inner sleeves, a cylindrical coupling fitted on the outer sleeve, the coupling including a rear inward flange, and a flexible sealing ring surrounded by the coupling, the ring including a flared front end, a flared rear end urged against the flange, and a narrow intermediate section. Inserting the cable into the coupling will fit an outer insulator of the cable in the inner sleeve to electrically couple the cable and the connector together with an outer conductor and a shield of the cable disposed inside the outer sleeve. Pushing the coupling will compress the ring to urge against the front end of the ring against the rear end of the outer sleeve and recess the intermediate section to fasten on the shield. This can prohibit moisture from entering thereinto, thereby preventing internal conductive members from being rusted.

3 Claims, 4 Drawing Sheets

CONNECTOR FOR COAXIAL CABLE

BACKGROUND OF THE INVENTION

1. Field of the Invention

The present invention relates to connectors and more particularly to a connector connectable to a coaxial cable coupled to a cable TV or computer monitor, the coupled connector and the cable being adapted to prevent moisture from entering into the coupled portion and thus preventing conductive members inside the coupled portion from being rusted.

2. Description of Related Art

Connectors for coaxial cable are well known. A conventional F class connector of an electrical device (e.g., TV, radio, or the like) is threadedly coupled to a coaxial cable so that the electrical device is able to receive signals via the cable.

A conventional F class connector 10 for coaxial cable is shown in FIGS. 1A and 1B. The connector 10 comprises a body 11 including a rear, cylindrical shell 12, an internal sleeve 13 surrounded by the shell 12, and a forward nut 14 having internal threads coupled to a front end of the sleeve 13 (see FIG. 1A). As shown in FIG. 1B, the connector 10 is coupled to one end of a coaxial cable 16 comprising a central conductor and an internal insulator (not shown) surrounded the central conductor. Both the central conductor and the internal insulator are inserted into the sleeve 13. The cable further comprises a braided outer conductor (not shown) surrounded the internal insulator and a shield. Both the outer conductor and the shield are fitted in the space between the shell 12 and the sleeve 13. Furthermore, the nut 14 is threadedly secured to a mated connector of an electrical device (not shown). Finally, a tool (e.g., pliers) is used to press the shell 12 against the shield of the cable 16 for fastening the connector 10 and the cable 16 together.

However, the prior art suffered from a disadvantage. For example, a plurality of (e.g., six) gaps 17 are formed between the shield and the shell 12. As such, moisture may enter into the connector through the gaps 17. Eventually, rust may form inside the connector (i.e., at the braided outer conductor and the central conductor). As understood that rust may degrade the signal transmission quality.

Thus, it is desirable to provide a novel connector for coaxial cable in which the coupled connector and the cable are adapted to prevent moisture from entering into the coupled portion and thus prevent conductive members inside the coupled portion from being rusted.

SUMMARY OF THE INVENTION

It is an object of the present invention to provide a connector connectable to a coaxial cable including a central conductor, an outer insulator surrounded the central conductor, a braided outer conductor in the form of a cylindrical shell surrounded the outer insulator, and a shield surrounded the outer conductor, the connector comprising a body including an outer sleeve, an inner sleeve having a front, outer extending rim, an annular space formed between the outer and the inner sleeves, and a forward rotatable nut having a rear inwardly extending rim rotatably disposed between the outer extending rim and the outer sleeve; a hollow, cylindrical coupling fitted on a rear section of the outer sleeve, the cylindrical coupling including a rear inwardly extending flange; and a flexible sealing ring surrounded by the cylindrical coupling, the sealing ring including flared front and rear ends and a narrow intermediate section wherein the front end thereof is spaced apart from a rear end of the outer sleeve prior to coupling the connector to the cable and the rear end thereof is urged against the flange, whereby inserting the front end of the cable into the cylindrical coupling will snugly fit the outer insulator in the inner sleeve to couple the central conductor to a mated connector and dispose the outer conductor and the shield inside the outer sleeve; and pushing the cylindrical coupling forward will compress the sealing ring to urge against the front end of the sealing ring against the rear end of the outer sleeve and further recess the intermediate section to fasten on the shield. By utilizing the present invention, it is possible of preventing moisture from entering into the connector through the intermediate section and thus preventing the central and the outer conductors from being rusted by moisture.

In one aspect of the present invention the sealing ring is formed of either synthetic rubber or elastomeric material.

In another aspect of the present invention the flange comprises an annular slope inwardly extended, and an annular gap between the slope and an inner wall of the cylindrical coupling so as to fit the rear end of the sealing ring therein.

The above and other objects, features and advantages of the present invention will become apparent from the following detailed description taken with the accompanying drawings.

DETAILED DESCRIPTION OF THE PREFERRED EMBODIMENTS

Figure 5A:
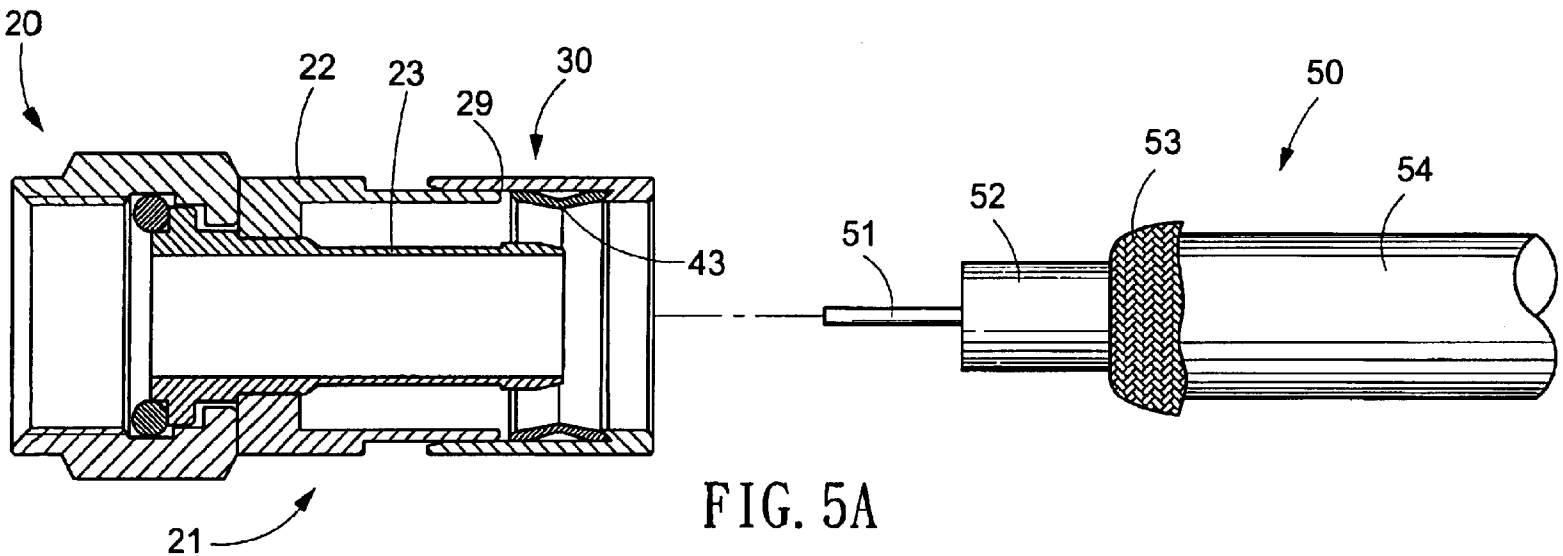
FIGS. 5A and 5B are cross-sectional views for illustrating the connector and a coaxial cable prior to coupling and after being coupled respectively.

Referring to FIG. 5A, a coaxial cable 50 comprises a central conductor 51, an outer insulator 52 surrounded the central conductor 51, a braided outer conductor 53 in the form of a cylindrical shell surrounded the outer insulator 52, and a shield 54 surrounded the outer conductor 53. For connecting to a connector of the invention, one ends of the central conductor 51 and the outer insulator 52 are exposed. Also, one end of the outer conductor 53 is exposed and is covered on one end of the shield 54.

Figure 1A:
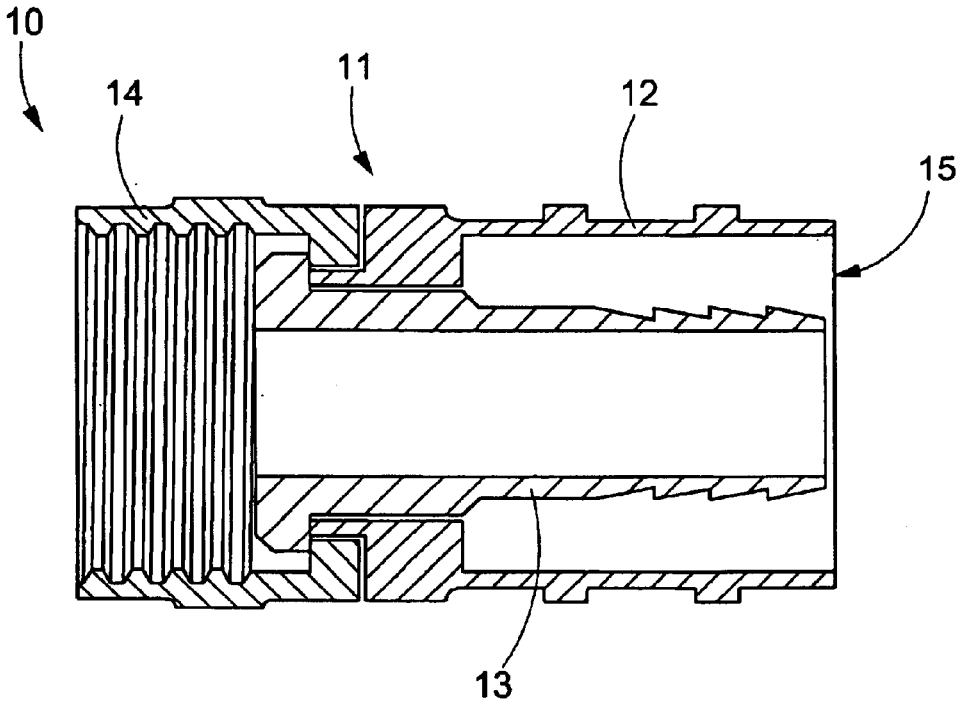
FIG. 1A PRIOR ART
FIG. 1A is a cross-sectional view of a conventional connector for coaxial cable.
Figure 1B:
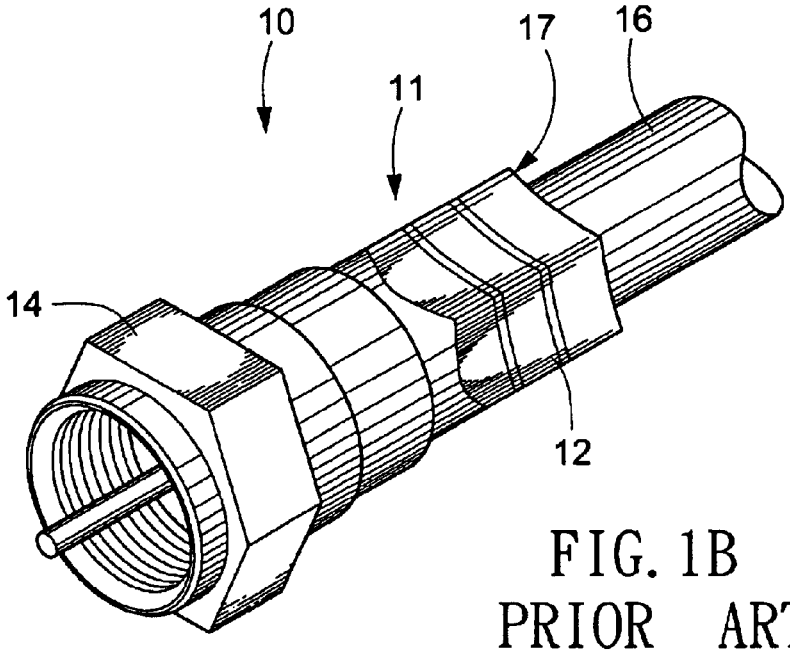
FIG. 1B PRIOR ART
FIG. 1B is a perspective view of the connector coupled to one end of the cable.
Figure 2A:
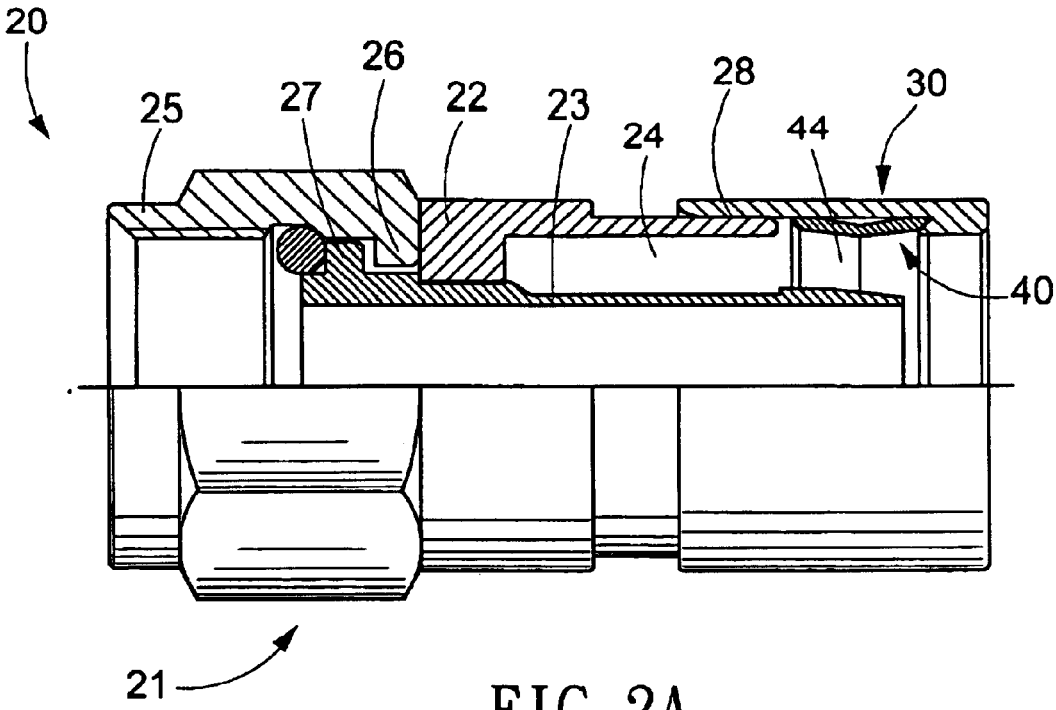
FIGS. 2A and 2B are partial and full cross-sectional views of a connector according to the invention respectively.
Figure 2B:
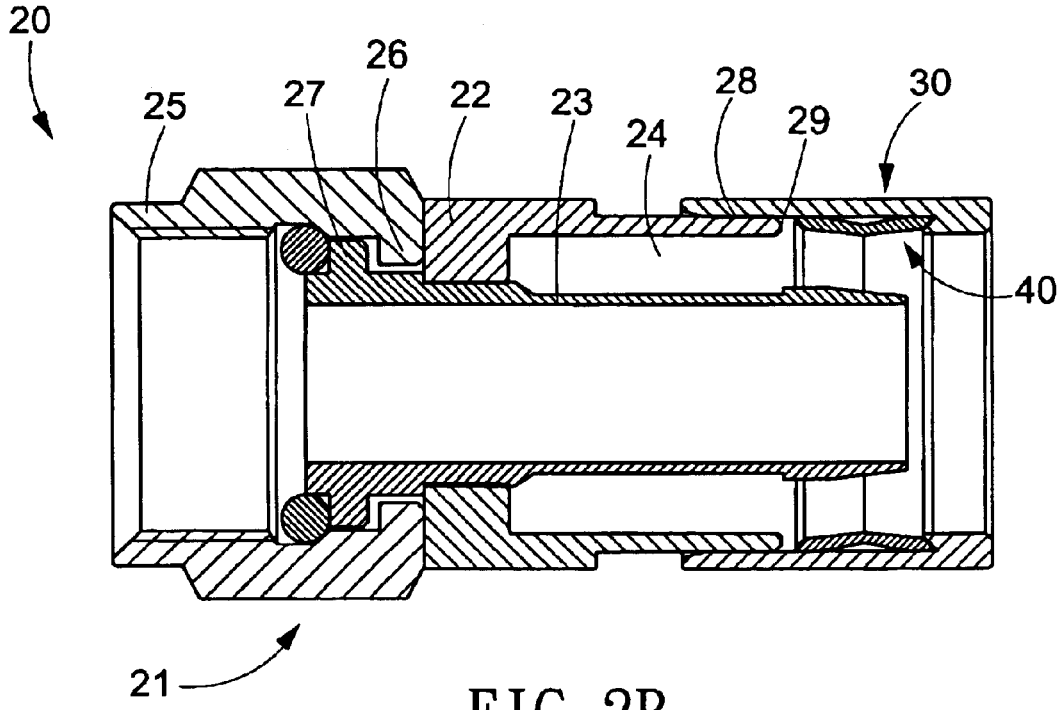

Referring to FIGS. 2A and 2B, a connector 20 of the invention is shown. The connector 20 comprises a body 21 including an outer sleeve 22, an inner sleeve 23 surrounded by the outer sleeve 22, the inner sleeve 23 having an outer extending rim 27 in the forward end, an annular space 24 formed between the outer and the inner sleeves 22 and 23, and a forward rotatable nut 25 having an inwardly extending rim 26 in the rear, the rim 26 being rotatably disposed between the outer extending rim 27 and the outer sleeve 22, a hollow, cylindrical coupling 30 fitted on a rear section 28 of the outer sleeve 22, and a flexible sealing ring 40 surrounded by the cylindrical coupling 30, the sealing ring 40 being spaced apart from a rear end 29 of the outer sleeve 22 prior to coupling the connector 20 to a cable as described later.

Figure 3:
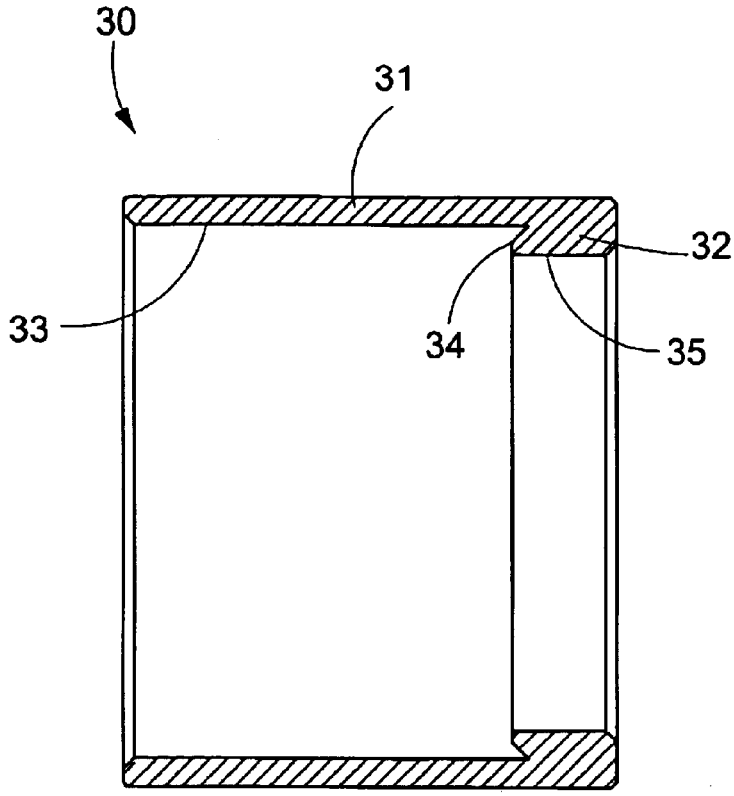
FIG. 3 is a cross-sectional view of the hollow, cylindrical coupling.

Referring to FIGS. 3, the cylindrical coupling 30 comprises a cylindrical portion 31, an inwardly extending rim 32 in the rear, a first bore 33 surrounded by the cylindrical portion 31, the first bore 33 being conformed to sleeve on the rear section 28 of the outer sleeve 22, an annular slope 34 on the rim 32, the slope 34 being inwardly extended toward the first bore 33, and a second bore 35 formed by the rim 32, the second bore 35 being smaller than the first bore 33.

Figure 4:
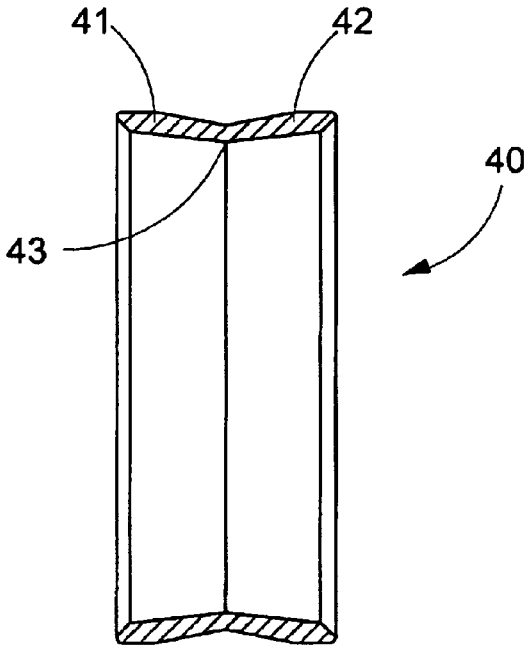
FIG. 4 is a cross-sectional view of the sealing ring.

Referring to FIG. 4, the sealing ring 40 is formed of synthetic rubber or elastomeric material such as neoprene. The sealing ring 40 comprises flared front and rear ends 41, 42, a narrow intermediate section 43, and an internal bore 44 in which the rear end 42 is fitted in an annular gap formed between the slope 34 and the inner wall of the cylindrical portion 31 prior to coupling the connector 20 to the cable 50.

Figure 5B:
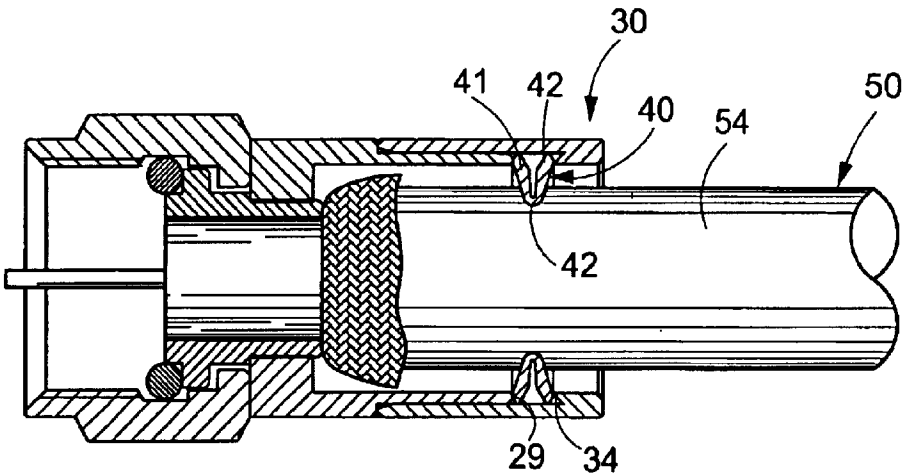

Referring to FIG. 5B in conjunction with FIG. 5A, the coupling operation of the connector 20 and the cable 50 will now be described in detail below. First, insert the front end of the cable 50 into the cylindrical coupling 30 with the outer insulator 52 snugly fitted in the inner sleeve 23 and the central conductor 51 further inserted into a conductive sleeve of a mated connector of an electrical device (not shown) for electrical connection. Also, the outer conductor 53 and the shield 54 are disposed inside the outer sleeve 22. Next, use a tool or the hand to push the cylindrical coupling 30 toward the forward side to compress the sealing ring 40. As a result, the front end 41 is urged against the rear end 29 of the outer sleeve 22 and the intermediate section 43 is further recessed to fasten at the outer surface of the shield 54. This has the advantage of preventing moisture from entering into the connector 20 through the intermediate section 43 and thus preventing the central and the outer conductors 51 and 53 from being rusted by moisture.

While the invention herein disclosed has been described by means of specific embodiments, numerous modifications and variations could be made thereto by those skilled in the art without departing from the scope and spirit of the invention set forth in the claims.

What is claimed is:

1. A connector connectable to a coaxial cable including a central conductor, an outer insulator surrounded the central conductor, a braided outer conductor in the form of a cylindrical shell surrounded the outer insulator, and a shield surrounded the outer conductor, the connector comprising:

a body including an outer sleeve, an inner sleeve having a front, outer extending rim, an annular space formed between the outer and the inner sleeves, and a forward rotatable nut having a rear inwardly extending rim rotatably disposed between the outer extending rim and the outer sleeve;

a hollow, cylindrical coupling fitted on a rear section of the outer sleeve, the cylindrical coupling including a rear inwardly extending flange; and a flexible sealing ring surrounded by the cylindrical coupling, the sealing ring including flared front and rear ends and a narrow intermediate section wherein the front end thereof is spaced apart from a rear end of the outer sleeve prior to coupling the connector to the cable and the rear end thereof is urged against the flange, whereby inserting the front end of the cable into the cylindrical coupling will snugly fit the outer insulator in the inner sleeve to couple the central conductor to a mated connector and dispose the outer conductor and the shield inside the outer sleeve; and pushing the cylindrical coupling forward will compress the sealing ring to urge against the front end of the sealing ring against the rear end of the outer sleeve and further recess the intermediate section to fasten on the shield.

2. The connector of claim 1, wherein the sealing ring is formed of either synthetic rubber or elastomeric material.

3. The connector of claim 1, wherein the flange comprises an annular slope inwardly extended, and an annular gap between the slope and an inner wall of the cylindrical coupling so as to fit the rear end of the sealing ring therein.

* * * * *